US005100141A

United States Patent [19]

Fitch

[11] Patent Number: 5,100,141

[45] Date of Patent: Mar. 31, 1992

[54] DICE SCRAMBLER

[76] Inventor: Robert B. Fitch, 443 Falke Ct., Anchorage, Ak. 99504

[21] Appl. No.: 710,505

[22] Filed: Jun. 3, 1991

[51] Int. Cl.[5] ..... A63F 9/04

[52] U.S. Cl. ..... 273/145 B; 273/145 R; 273/145 C; 273/145 CA

[58] Field of Search ..... 273/145 R, 145 B, 145 CA, 273/144 R, 144 A, 144 B, 145 C

[56] References Cited

U.S. PATENT DOCUMENTS

| | | | |
|---|---|---|---|
| 993,392 | 5/1911 | Miller | 273/145 B |
| 3,468,543 | 9/1969 | Dove . | |
| 3,951,412 | 4/1976 | Adams | 273/145 B |
| 4,875,688 | 10/1989 | Whaley | 273/285 |

FOREIGN PATENT DOCUMENTS

| | | | |
|---|---|---|---|
| 561934 | 8/1958 | Canada | 273/145 B |
| 1118001 | 2/1982 | Canada | 273/145 B |

*Primary Examiner*—Benjamin Layno

*Assistant Examiner*—Steven B. Wong

*Attorney, Agent, or Firm*—Kelly, Bauersfeld & Lowry

[57] ABSTRACT

A device for scrambling dice and the like includes a pair of housing bodies which collectively define a generally vertical chute for directing dice from an upper entryway to a lower discharge opening. A door is attached adjacent to a lower edge of the discharge opening and is pivotable between a first position wherein the door closes the discharge opening, and a second position wherein the door provides a ramp for directing dice falling downwardly through the chute away from the housing through the discharge opening. A plurality of pins and baffles extending into the chute deflect dice falling downwardly through the chute. In one embodiment, the pins may be removed and repositioned as desired. The housing bodies are further configured to provide a closed container for the dice to facilitate shipping and storage of the dice within the dice scrambler.

11 Claims, 1 Drawing Sheet

DICE SCRAMBLER

BACKGROUND OF THE INVENTION

This invention relates to the scrambling of dice or like items bearing surface markings, which are often utilized in connection with board games. More specifically, the present invention relates to a self-contained device designed to tumble dice and like objects, which can also be used to securely contain the dice for storage and shipping purposes.

Many games utilize dice or other three-dimensional objects (pyramids) bearing indicia on adjacent surfaces. Both board games such as MONOPOLY, and non-board games such as YAHTZEE, require players to roll dice to play the games. Customarily, the dice are rolled by the player taking his turn by simply throwing them onto the board or a suitable horizontal surface. The dice are scrambled in widely varying degrees either in the player's hand, or in a cup provided for scrambling and throwing the dice.

Obviously, scrambling and throwing the dice from a players hand or a hand held cup may give one player an advantage over another. Further, even when a cup is provided with a particular game, there is typically no secure means for storing the dice or like objects when the game is not in use. An effort to overcome some of these drawbacks, dice shakers, such as that illustrated in U.S. Pat. No. 3,468,543 have been developed. Such dice shakers, however, provide a minimal level of scrambling and are often of an unduly complicated design.

Accordingly, there has been a need for a novel device for scrambling dice and the like, which is of simple construction, and is easy to understand and use. Additionally, there exists a need for a dice scrambler capable of deflecting dice traveling therethrough in three planes, and includes pins which may be repositioned to change the scrambling characteristics of the device as desired. Further, a dice scrambler is needed which can be configured for both tumbling dice and presenting the scrambled results in a preselected area, and which can be reconfigured to provide a closed container for the device for storage and shipping purposes. The present invention fulfills these needs and provides other related advantages.

SUMMARY OF THE INVENTION

The present invention resides in an improved device for scrambling dice and the like, which is of simplified construction and is capable of efficiently scrambling a plurality of dies or like objects simultaneously and achieving satisfactory results. The dice scrambler comprises, generally, a housing which forms a generally vertical chute, means for deflecting dice falling downwardly through the chute in three planes whereby the dice are randomly scrambled, and means for directing dice falling through the chute away from the scrambling device. The deflecting means includes a plurality of pins attached to the housing and extending into the chute.

In a preferred form of the invention, the housing includes a first housing body having an open upper end, and a second housing body having an open upper end and an aperture in a front face thereof. Means are provided for removably connecting the first and the second housing bodies together such that the open upper ends form an upper entryway for the device, the aperture in the front face of the second housing body forms a lower discharge opening for the device, and the housing bodies collectively define the generally vertical chute for directing the dice from the entryway to the discharge opening. The housing bodies are configured to provide a closed container for the dice when the first housing body is inverted relative to the second housing body and nested within the second housing body. The connecting means includes mating snap connectors disposed at facing ends of corresponding pins extending from the housing bodies into the chute.

The directing means comprises a door attached to the second housing body adjacent to a lower edge of the aperture in the front face of the second housing body. The door is pivotable between a first position wherein the door closes the discharge opening, and a second position wherein the door provides a ramp for directing dice deposited into the connected housing bodies through the entryway, away from the housing through the discharge opening. The first housing body includes a support for positioning the door in its second position.

The deflecting means includes baffles fixed to the housing bodies which, with the pins, deflect dice falling downwardly through the chute in three planes. The pins may be tapered away from the supporting housing body to deflect dice striking them at an oblique angle. In an alternative illustrated embodiment, some of the pins are removable from the supporting housing body and repositionable thereon to change the scrambling characteristics of the scrambling device.

The scrambling device may be positioned within a tray which receives the dice as they exit through the discharge opening.

The pins are situated within the housing bodies such that when one housing body is inverted relative to the other, the door is securely held in its first position whereby dice stored between the nested and inverted housing bodies are not permitted means of escape.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
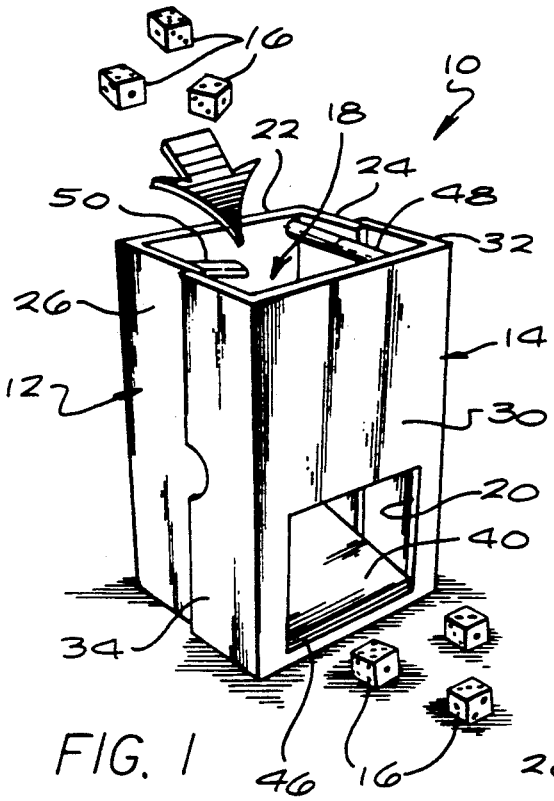
FIG. 1 is a perspective view of one preferred form of a dice scrambler embodying the invention.

As shown in the drawings for purposes of illustration, the present invention is concerned with an improved dice scrambler, generally designated in the accompanying drawings by the reference number 10. In accordance with the present invention, and as illustrated in connection with a first preferred embodiment in FIGS. 1–3, the dice scrambler 10 comprises a rear housing body 12 and a front housing body 14 which, when attached together as shown in FIG. 1, provide a generally vertical chute for directing dice 16 from an upper entryway 18 to a lower discharge opening 20.

The rear housing body 12 includes a rear wall 22 bounded on three sides with forwardly projecting side walls 24 and 26, and a bottom wall 28. The upper end of the rear wall 22 is not bounded by a wall, and the gap defined between the upper ends of the side walls 24 and 26 forms a portion of the upper entryway 18.

Figure 3:
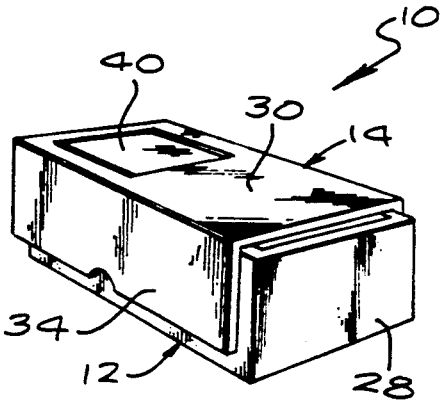
FIG. 3 is another perspective view of the dice scrambler illustrated in FIGS. 1 and 2, wherein the housing body halves are inverted and nested within one another to form a closed container for the dice.

The front housing body 14 is similarly constructed to include a front wall 30 bounded on three sides by rearwardly projecting side walls 32 and 34, and a bottom wall 36. Each of the rearwardly projecting side walls 32 and 34 include finger notches 38 which facilitate grasping the front housing body 14 and removing it from the rear housing body 12 when configured as illustrated in FIG. 3. The front housing body 14 is further configured to be slightly larger then the rear housing body 12 so that the rearwardly projecting side walls 32 and 34 can slide over the forwardly projecting side walls 24 and 26.

The front housing body 14 further includes a rectangular aperture in the front wall 30, which forms the discharge opening 20. A door 40 is pivotally fixed to the front wall 30 adjacent to a lower edge of the discharge opening 20. The door 40 is pivotable between a first position wherein the door closes the discharge opening 20 (FIG. 3), and a second position wherein the door provides a ramp for directing the dice 16 deposited into the connected housing bodies through the upper entryway 18, away from the housing bodies 12 and 14 through the discharge opening 20. The door 40 includes a lip 42 configured to engage a portion of the front wall 30 surrounding the discharge opening 20 to prevent the door 40 from swinging outwardly from the front housing body 14. When the lip 42 engages a portion of the front wall 30, the door 40 is securely situated in its first position. The rear housing body 12 includes a door support bar 44 fixed to the rear wall 22. The door support bar 44 provides a supporting surface for a portion of the door 40 adjacent to the lip 42 and opposite the flexible hinge 46, for securely situating the door 40 in its second position.

Each of the housing bodies 12 and 14 support several pins 48 and baffles 50. The pins and baffles provide means for deflecting dice falling downwardly through the chute in three planes whereby the dice 16 are randomly scrambled. The deflection pins 48 may be square, rectangular or cylindrical as shown. Further, tapered pins 52 may be provided for deflecting the dice 16 at an oblique angle to further improve the scrambling characteristics of the dice scrambler 10.

The housing bodies 12 and 14 are connected to one another in the use or play configuration illustrated in FIG. 1, utilizing mating snap connectors 54 and 56. The snap connectors 54 and 56 are each disposed at facing ends of corresponding pins 48 extending from the housing bodies 12 and 14 into the chute. The snap connectors 56 and 58 connect the rear housing body 12 to the front housing body 14 such that the open upper ends form the upper entryway 18 for the dice 16, and such that the housing bodies collectively form the generally vertical chute for directing the dice from the entryway to the discharge opening 20.

Figure 2:
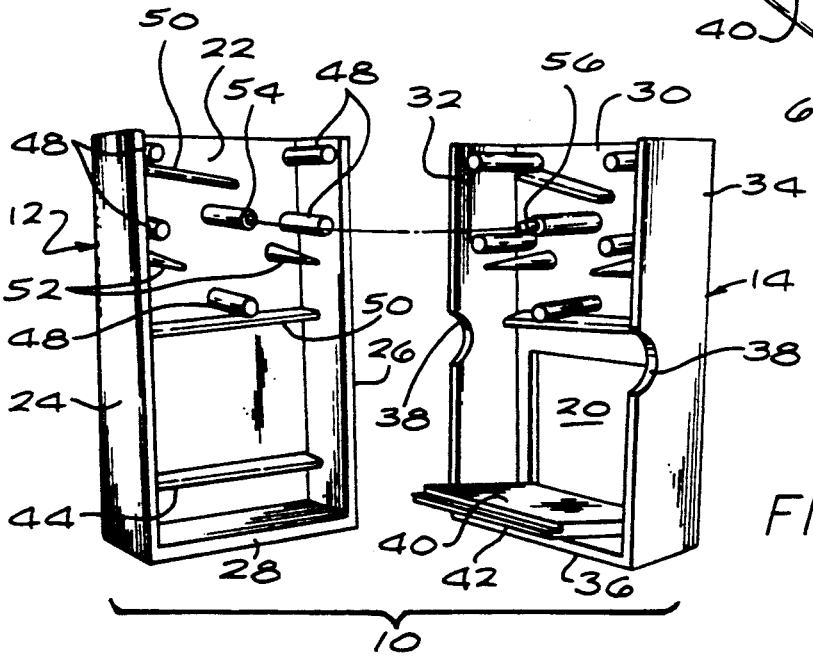
FIG. 2 is an exploded perspective view of the dice scrambler shown in FIG. 1, illustrating the pins, baffles, snap connectors and a door, all fixed to respective housing bodies.

As shown best in FIG. 2, the pins 48 and 52 and the baffles 50 are preferably attached to the respective housing bodies 12 and 14 only within the upper half of the chute. This feature permits one of the housing bodies to be inverted with respect to the other to provide a closed container for the dice 16 (see FIG. 3). More specifically, after the rear housing body 12 has been detached from the front housing body 14 by disengaging the snap connectors 54 and 56, the rear housing body may be inverted and placed within the front housing body 14 such that the pins 48 and 52 of the rear housing body lie generally adjacent to an inner surface of the door 40. This advantageously holds the door in its first position where the lip 42 engages a portion of the front wall 30 surrounding the discharge opening 20. A box-like container is then provided by the housing bodies 12 and 14 for storing the dice 16 therein. The box-like container is defined by the front and rear walls 30 and 22, the rearwardly projecting side walls 32 and 34 and the bottom walls 28 and 36.

Figure 4:
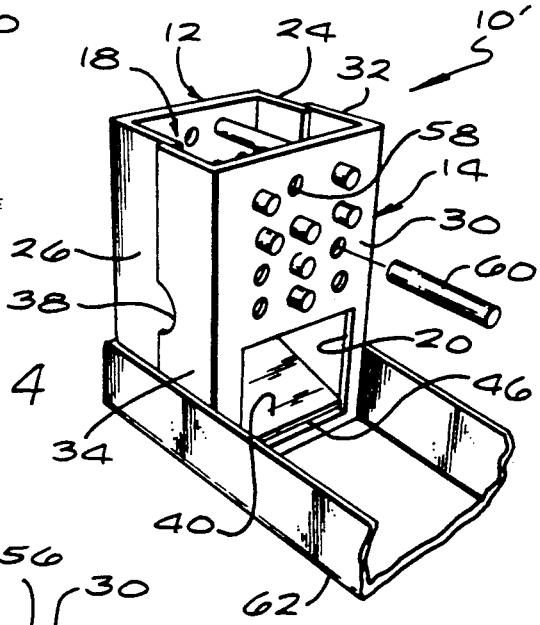
FIG. 4 is a perspective view of an alternative form of the dice scrambler embodying the invention, including pins capable of being removed from the housing and repositioned as desired to change the scrambling characteristics of the device.

In an alternative embodiment illustrated in FIG. 4, the front and rear walls 30 and 22 are provided with a plurality of apertures 58 dimensioned to receive removable pins 60 therein. In this embodiment the pins are removable from the housing bodies 12 and 14 and the chute defined therebetween, and are repositionable within the chute to change the scrambling characteristics of the dice scrambler 10.

If desired, a tray 62 can be provided for use in either of the illustrated embodiments for capturing the dice 16 after they exit through the discharge opening 20. Use of a tray 62 may be useful if the playing surface is not hard and flat. Of course, the inner surfaces of the housing bodies 12 and 14 and tray 62 may be lined with felt or the like as in the case of conventional dice tables.

To use the dice scrambler 10 of the present invention, the front and rear housing bodies 14 and 12 are snapped together utilizing the snap connectors 54 and 56 into the configuration illustrated in FIG. 1. Dice dropped through the upper entryway 18 strike the pins 48 and 52 and the baffles 50 as they drop downwardly through the chute. This has the effect of deflecting the dice in three planes, i.e., they bounce up and down, side to side and front to back. The dice scrambler 10 scrambles the dice 16 randomly, and when the dice 16 approach the bottom of the dice scrambler 10 they strike the door 40 and are deflected out of the device through the discharge opening 20. The dice scrambler 10 is designed to roll or tumble dice or other like items such as pyramid devices having markings on the surfaces thereof. The scrambler 10 is suitable for use with various sizes and shapes of dice and like items, and effectively scrambles one or many such items at the same time. Preferably, the scrambler 10 is manufactured of plastic, and the pins 48 need not be of uniform length.

From the foregoing it is to be appreciated that the dice scrambler 10 is of simplified construction to minimize manufacturing costs. Its simplicity makes the scrambler 10 easy to understand and use even by young children. The dice scrambler 10 may also be utilized to store the dice 16 when not in use by simply inverting one of the housing bodies with respect to the other and, in one of the embodiments, the pins 48 may be repositioned to change the scrambling characteristics of the device.

Although two particular embodiments of the invention have been described in detail for purposes of illustration, various modifications of each may be made without departing from the spirit and scope of the invention. Accordingly, the invention is not to be limited, except as by the appended claims.

I claim:

1. A device for scrambling dice, comprising:

a first housing body having an open upper end;

a second housing body having an open upper end and an aperture in a front face thereof;

means for removably connecting the first and the second housing bodies such that the open upper ends form an upper entryway for the dice, the aperture in the front face of the second housing body forms a lower discharge opening for the dice, and the housing bodies collectively form a generally vertical chute for directing the dice from the entryway to the discharge opening;

a door attached to the second housing body and pivotable between a first position wherein the door closes the discharge opening, and a second position wherein the door provides an inwardly disposed sloped ramp for directing dice deposited into the connected housing bodies through the entryway away from the housing bodies through the discharge opening, the first housing body including a support for positioning the door in its second position; and means for deflecting dice falling downwardly through the chute, whereby the dice are randomly scrambled, the deflecting means including a plurality of pins attached to at least one of the housing bodies and extending into the chute.

2. A dice scrambling device as set forth in claim 1, wherein the deflecting means includes baffles fixed to the housing bodies which, with the pins, deflect dice falling downwardly through the chute in three planes.

3. A dice scrambling device as set forth in claim 1, wherein the pins are tapered away from the supporting housing body to deflect dice striking thereon at an oblique angle.

4. A dice scrambling device as set forth in claim 1, wherein at least some of the pins are removable from the supporting housing body and repositionable thereon to change the scrambling characteristics of the scrambling device.

5. A dice scrambling device as set forth in claim 1, including a tray for receiving dice exiting the discharge opening.

6. A dice scrambling device as set forth in claim 1, wherein the door is pivotally affixed adjacent to a lower edge of the aperture in the front face of the second housing body.

7. A dice scrambling device as set forth in claim 1, wherein the connecting means includes a mating snap connector disposed at facing ends of corresponding pins extending from the housing bodies into the chute.

8. A dice scrambling device as set forth in claim 1, wherein the housing bodies are configured to provide a closed container for the dice when the first housing body is inverted relative to the second housing body and nested within the second housing body.

9. A dice scrambling device as set forth in claim 8, including means for securely holding the door in its first position when the first housing body is inverted relative to the second housing body and nested within the second housing body, to provide the closed container.

10. A device for scrambling dice, comprising:

a first housing body having an open upper end, a second housing body having an open upper end and an aperture in a front face thereof, wherein the housing bodies are configured to provide a closed container for the dice when the first housing body is inverted relative to the second housing body and nested within the second housing body;

means for removably connecting the first and second housing bodies such that the open upper ends form an upper entryway for the dice, the aperture in the front face of the second housing body forms a lower discharge opening for the dice, and the housing bodies collectively form a generally vertical chute for directing the dice from the entryway to the discharge opening, the connecting means including mating snap connectors disposed at facing ends of corresponding pins extending from the housing bodies into the chute;

a door attached to the second housing body and pivotable between a first position wherein the door closes the discharge opening when the first housing body is inverted relative to the second housing body and nested within the second housing body, and a second position wherein the door provides an inwardly disposed sloped ramp for directing dice deposited into the connected housing bodies through the entryway away from the housing through the discharge opening, wherein the door is pivotally fixed adjacent to a lower edge of the aperture in the front face of the second housing body, and wherein the first housing body includes a support for positioning the door in its second position; and means for deflecting dice falling downwardly through the chute, whereby the dice are randomly scrambled, the deflecting means including a plurality of pins attached to at least one of the housing bodies and extending into the chute, the deflecting means further including baffles fixed to the housing bodies which, with the pins, deflect dice falling downwardly through the chute in three planes, at least one of the pins being tapered away from the supporting housing body to deflect dice striking it at an oblique angle, some of the pins being removable from the respective supporting housing body and repositionable thereon to change the scrambling characteristics of the scrambling device.

11. A dice scrambling device as set forth in claim 10, including a tray for receiving dice exiting the discharge opening.

* * * * *